US005346208A

United States Patent [19]

Wood, Sr.

[11] Patent Number: 5,346,208

[45] Date of Patent: Sep. 13, 1994

[54] BASEBALL GLOVE TRAINING DEVICE

[76] Inventor: Albert T. Wood, Sr., Rd. 1, Box 481, Felton, Del. 19943

[21] Appl. No.: 59,124

[22] Filed: May 10, 1993

[51] Int. Cl.[5] ..... A63B 71/02

[52] U.S. Cl. ..... 273/26 C

[58] Field of Search ..... 273/26 C, 26 R; 2/19

[56] References Cited

U.S. PATENT DOCUMENTS 4,121,824 10/1978 Hirschfield ..... 273/26 C
4,637,610 1/1987 Carr ..... 273/26 C
4,802,669 2/1989 Birmingham ..... 273/26 C
4,817,209 4/1989 Lehmann ..... 2/19
4,874,168 10/1989 Wright ..... 273/26 C

*Primary Examiner*—Theatrice Brown
*Attorney, Agent, or Firm*—Richard C. Litman

[57] ABSTRACT

A baseball glove training device used to train players to catch a thrown or hit ball with both hands uses a semi-cylindrical solid piece attached to the back portion of the glove so as to prevent the player from closing the glove on the ball. Rather, the player has to catch the ball between the glove and the throwing hand.

3 Claims, 3 Drawing Sheets

BASEBALL GLOVE TRAINING DEVICE

BACKGROUND OF THE INVENTION

1. Field of the Invention

The present invention relates to baseball glove training devices designed to aid coaches in teaching their players to catch a thrown or hit ball in the palm of the glove instead of in the web of the glove. More particularly, the preset invention pertains to those baseball glove training devices which attach to the back portion of the player's glove so as to prevent a player from closing the glove. As a result, the player is forced to use both hands to catch the ball in the palm of the glove, thereby deflecting the ball into the throwing hand already in front of the glove before the ball reaches the player. This teaches the player to get rid of the ball quickly once the ball is caught, which is referred to as developing quick hands.

2. Description of the Prior Art

Baseball glove training aids have been designed to teach a player to catch the ball with two hands by glancing an incoming ball off a device held on the catching hand and into the throwing hand, so as to aid the player in developing quick hands. Many gloves are designed with large webs which are designed to collapse as the ball enters the web. With this type of glove, the player is encouraged to one hand catch the ball in the web of the glove. There are disadvantages with one handed catches. One disadvantage is the time elapsed between catching the ball and getting rid of the ball. The player loses time in having to reach into the glove and pull the ball out. The player can get rid of the ball quicker if he or she glances the ball off the palm of the glove and into the throwing hand, which is in front of the glove before the ball reaches the player. While the player is catching the ball with both hands, he or she is also positioning his or her feet arid shoulders to through the ball to another player. This technique is often used by infielders when trying to turn a double play, or by outfielders when trying to prevent runners from advancing.

U.S. Pat. No. 4,121,824 issued Oct. 24, 1978 to Robert K. Hirschfield discloses a baseball training glove having a inflexible web which prevents the ball from being trapped in the web, thereby requiring a player wearing the glove to make a two-handed catch.

U.S. Pat. No. 4,637,610 issued Jan. 20, 1987 to Damon L. Carr discloses a baseball training device which forms a scoop made of rigid material to be placed inside of a glove, thereby preventing a player from closing the glove on a ball.

U.S. Pat. No. 4,802,669 issued Feb. 7, 1989 to Peter C. Birmingham discloses a baseball training device using a triangular shaped pad with rounded off corners. Straps located in the back of the pad wrap around the fingers of the player's catching hand. The player has to trap an incoming ball on the front of the pad with the throwing hand as the ball makes contact with the front of the pad.

U.S. Pat. No. 4,874,168 issued Oct. 17, 1989 to Robert L. Wright discloses a baseball glove training device similar Birmingham's device except for the shape of the pad, which is semicircular in shape.

U.S. Pat. No. 4,817,209 issued Apr. 4, 1989 to Roger W. Lehmann et al discloses a child's baseball glove having a strap attachable over the bottom of the glove to form a pocket over the palm of the glove, thereby allowing a young child more easily to catch and retain a ball in the pocket of the glove.

None of the above inventions and patents, taken either singly or in combination, is seen to describe the instant invention as claimed.

SUMMARY OF THE INVENTION

The baseball glove training device of the present invention attaches to the back portion of a conventional glove in order to prevent a player from closing the glove, thus encouraging a player to catch an incoming ball with both hands. The device is simple to manufacture since it consists only of a semi-cylindrical solid piece attached to the back side of the conventional glove and comes in two sizes, one to fit adult size gloves and the other for youth models. The semi-cylindrical solid piece does not come in contact with the ball as the player catches the ball since the it is located on the back side of the glove.

Accordingly, it is a principal object of the invention to provide a baseball glove training device which is attachable to conventional baseball or softball gloves.

It is another object of the invention to such a device which does not come in contact with the ball, thus allowing the glove to function as it was intended except for preventing the closure thereof.

It is a further object of the invention to provide such a device which is easy and inexpensive to manufacture and is easy to use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The baseball glove training device 1 of the present invention includes a semi-cylindrical solid piece 2 and a variety of ways for attaching the semi-cylindrical solid piece 2 to a back portion of a conventional glove so as to prevent the glove from being closed. There are basically two sizes of gloves sold on the market, an adult size and a youth size. Since the device of the present invention attaches only to the back side of the top portion of the glove, then the only relevant difference between the various gloves sold on the market is the ark of the back side of the various gloves when the glove is open. In order to fit the various gloves sold on the market, the present invention includes a youth size training aid device and an adult size training aid device. The differences therebetween the two sizes of the conventional adult sized glove and the convention youth sized glove will be discussed below.

Figure 1:
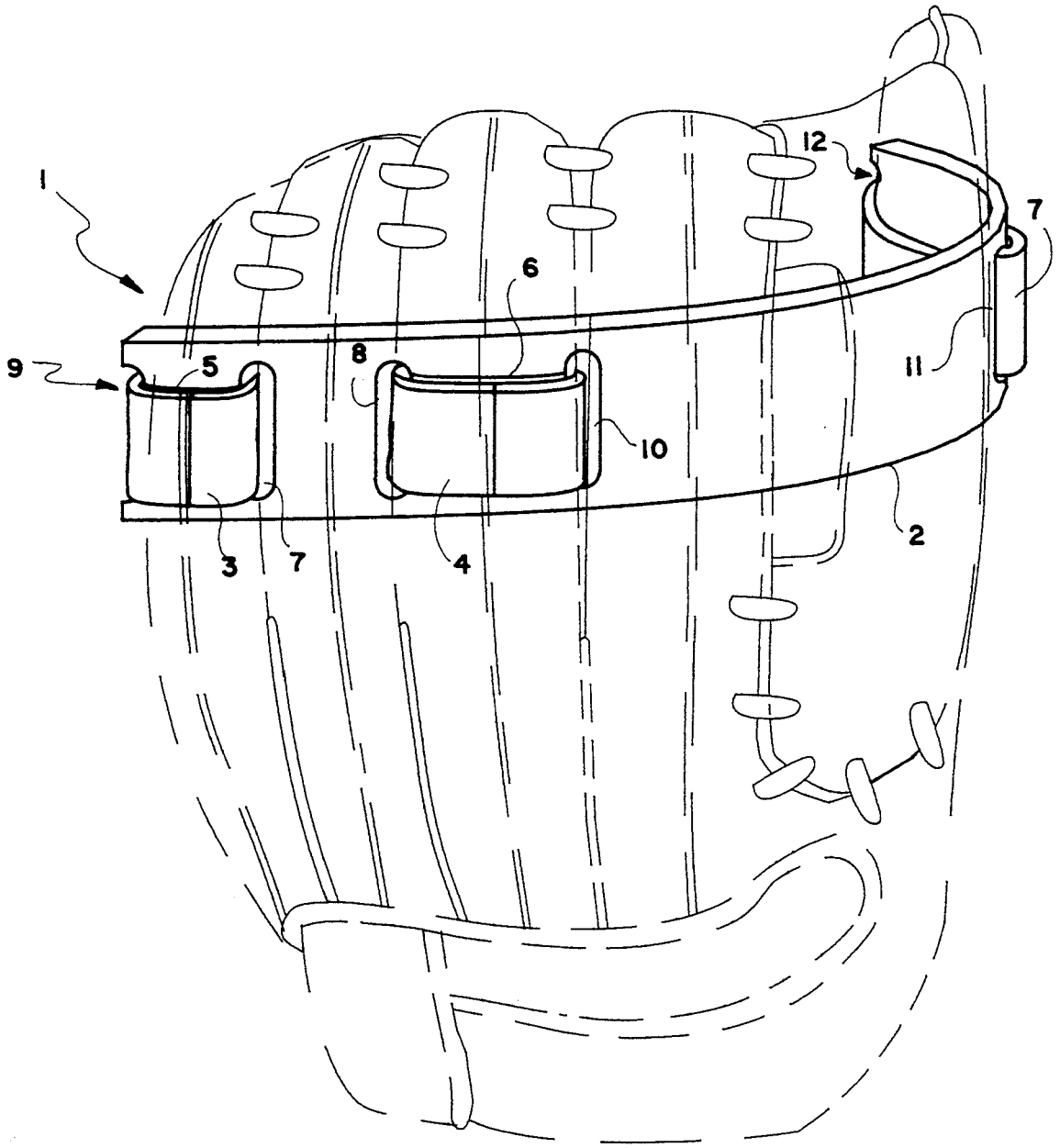
FIG. 1 is an environmental perspective view of the present invention attached to a glove having gaps between the web and the glove.

As shown in FIG. 1, one of the ways of attaching the semi-cylindrical solid piece 2 to a conventional glove is by hook and loop fasteners. A strip 3 having loop fasteners on one side thereof is inserted through a slot 7, around the little finger of the glove, back around to the back side of the glove, through a groove 9, and then back to the semi-cylindrical solid piece 2. Located on the back side of the semi-cylindrical solid piece 2 is a strip 5 of loop fasteners adhesively applied to the back side of the semi-cylindrical metal piece 2 between the slot 7 and the groove 9. One end of the strip 3 is fastened to a portion of strip 5 located closer to slot 7 and the other end of the strip 3 is fastened to the portion of strip 5 located closer to the groove 9. A strip 7 of hook fasteners is likewise placed around the thumb of the glove through a slot 11, and a groove 12, and is attached to the back side of the semi-cylindrical solid piece 2 through the use of a strip 17 of loop fasteners adhesively attached thereto between slot 11 and the groove 12 (see FIG. 3). Lastly, a strip 4 of hook fasteners is fastened around the middle finger of the glove through a pair of slots 8 and 10, One end of the strip 4 is attached to a portion a strip 6 of loop fasteners and the other end of the strip 4 is attached the remaining portion of the strip 6.

Figure 2:
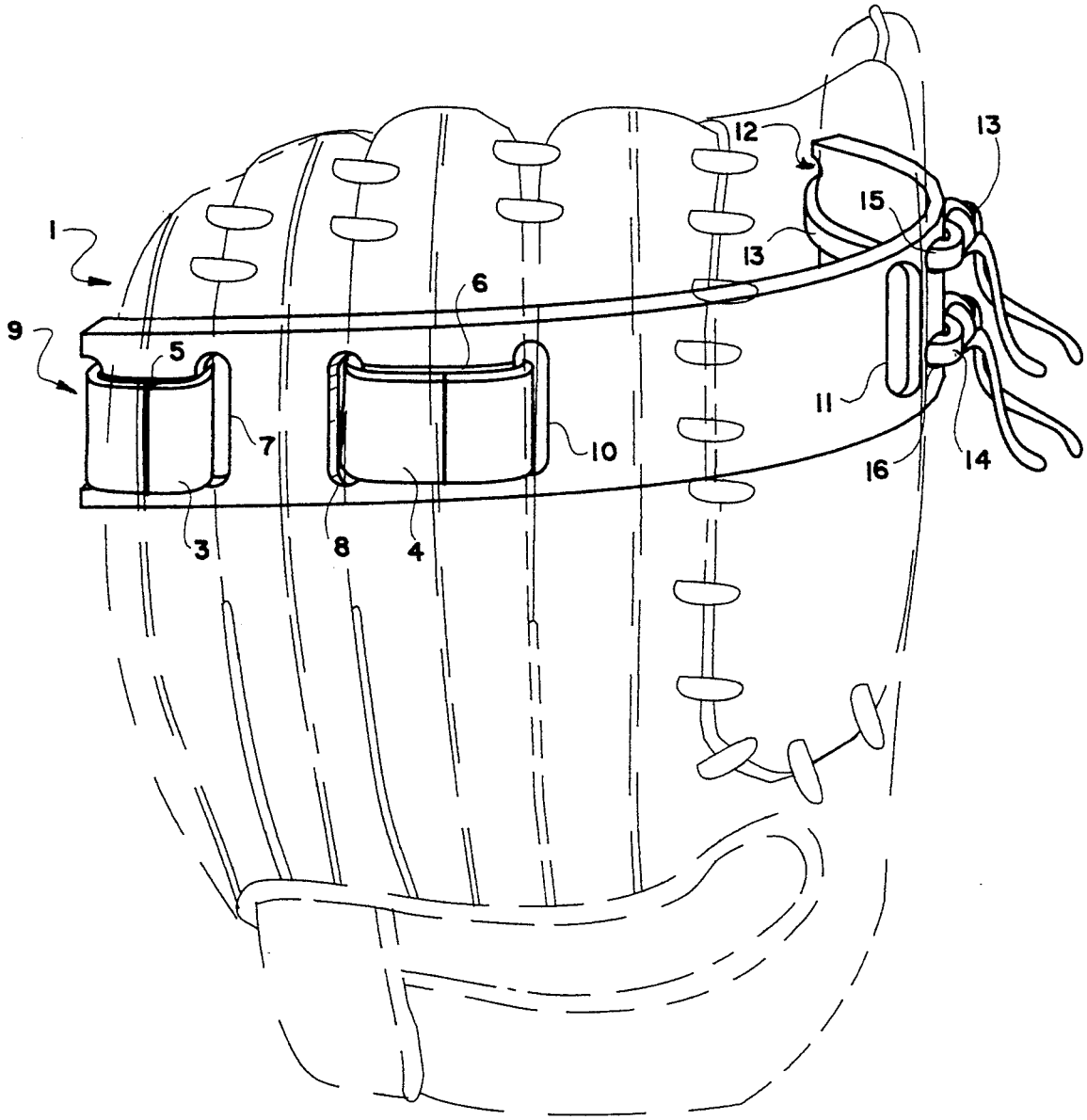
FIG. 2 is an environmental perspective view of the present invention attached to a glove having no gaps between the web and the glove.

As stated above, there are certain gloves whose web design includes stitching all the way around the outer portion of the web, as illustrated in FIG. 2. In this case, two leather strips 13 and 14 are provided which may be inserted between the stitches of the web. Two holes 15 and 16 are located on the semi-cylindrical solid piece 2 between the slot 11 and the strip 17. The leather strip 13, once placed between the stitching of the web portion of the glove, has the end thereof on the back side of the glove placed through the hole 15 and the other end on the front side of the glove placed around the thumb of the glove, through the groove 12, and back around the back side of the semi-cylindrical solid piece 2. The two ends of the leather strip are then tied together. Leather strip 14 is tied around the thumb in a similar fashion, having one end thereof located in the back of the glove placed through the hole 16 and the other end placed around the thumb of the glove, through the groove 12, and back around to the back portion of the semi-cylindrical solid piece 2. The ends of the leather strip 14 are then tied together. Note that the knots of the two leather strips are not located near the front of the glove so as not to interfere with the catching of the ball.

The semi-cylindrical solid portion 2 is preferably formed by curving a metal strip 20 of aluminum having the same strength as 18 gauge steel. The adult size baseball glove training device should be sixteen inches from the groove 9 to the groove 12 along the back side of the semi-cylindrical solid portion 2. For the adult size model designed to fit the conventional adult size baseball or softball glove, the length A between one end of the metal strip 20 and the slot 7 is two and a half inches (2.5″), the length B between slot 7 and slot 8 is two inches (2″), the length C between slot 8 and slot 10 is one and a half inches (1.5″), and the distance D between slot 10 and slot 11 is seven and a half inches (7.5″). The distance between slot 11 and the holes 15 and 16 is half an inch (0.5″), and the distance between the holes 15 and 16 to the other end of the metal strip 20 is two inches (2″). Due to the stretching of the metal strip 20 as it is bent into a semi-circular solid piece 2, the overall length of the metal strip 20 would have to be somewhat shorter than 16 inches for the adult size model. However, it is well within the scope of those of ordinary skill in the machinist art to be able to compensate for such factors.

Figure 3:
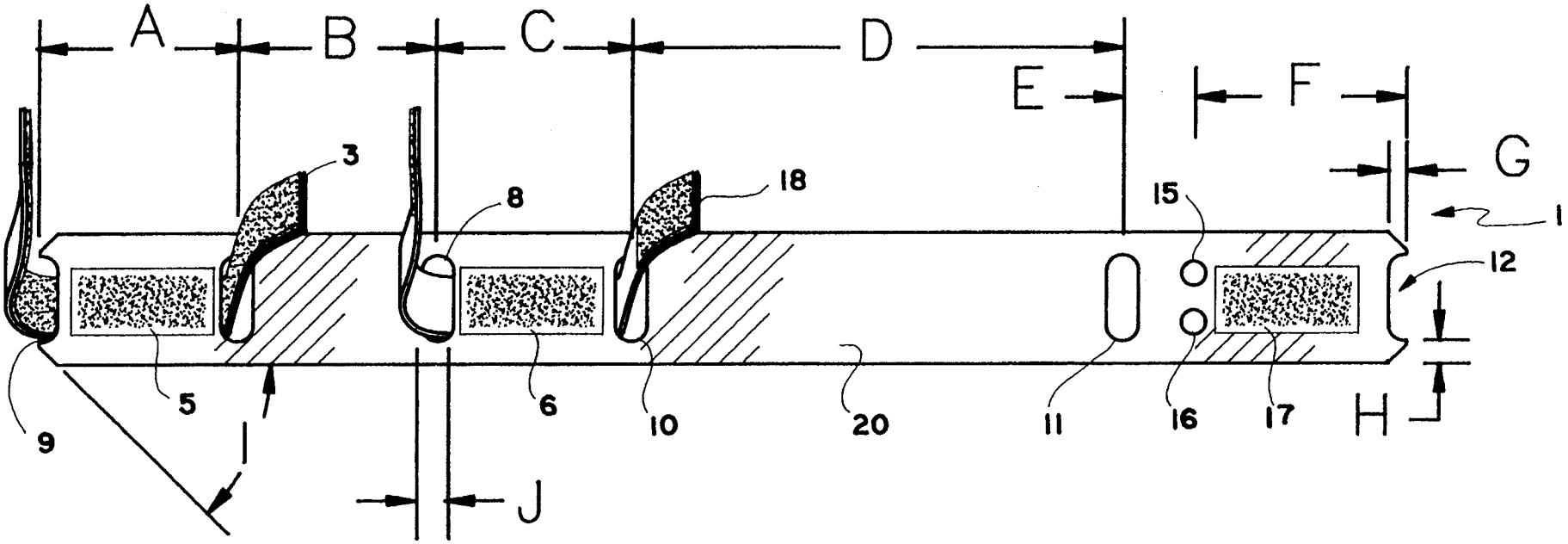
FIG. 3 is back view of semi-cylindrical metal piece before the piece is curved, i.e., while the piece is still a flat metal strip.

The youth model would vary from the adult size model only in the length D from the slot 10 to the slot 11. The length D would be five and a half inches (5.5″). In the preferred embodiment, for both adult and youth size models, the width of metal strip 20, and therefor the width of the semi-cylindrical solid piece 2, would be one and a half inches (1.5″). Also, the edges at the ends of the metal strip 20 should be remove so as to prevent injuries. The edges should be cut off at an angle 1 of forty-five (45) degrees. The grooves 9 and 12 should be centered along the width of the metal strip 20 and should be one inch (1″) long each. Thus the distance H should be a quarter of an inch (0.25″). The width J of each of the slots 7, 10, and 11, as well as the holes 15 and 16 is a quarter of an inch (0.25″). The length of the slots 7, 8, 10, and 11 is one inch (1″). As shown in FIG. 3, a nylon strip 18 with loop fasteners attached to one end thereof and hook fasteners attached to the other end thereof may be used instead of the strips with hook fasteners attached along one side thereof. The nylon strip 18 would be more durable.

It is to be understood that the present invention is not limited to the sole embodiment described above, but encompasses any and all embodiments within the scope of the following claims.

I claim:

1. A baseball glove training device comprising:

a semi-cylindrical solid piece; and means for attaching said semi-cylindrical solid piece to a back portion of a glove so as to prevent the glove from being closed, wherein said semi-cylindrical solid piece further comprises a first groove located at one end thereof and a second groove located at the other end thereof opposite said one end.

2. A baseball glove training device comprising:

a semi-cylindrical solid piece; and means for attaching said semi-cylindrical solid piece to a back portion of a glove so as to prevent the glove from being closed, wherein said means for attaching includes:

a first end slot located near one end of said semi-cylindrical solid piece;

a second end slot located near the other end of said semi-cylindrical solid piece opposite said one end; and a pair of middle slots located between said first end slot and said second end slot, a first strip of loop fasteners adhesively applied to said semi-cylindrical solid piece between said first end thereof and said first end slot;

a second strip of loop fasteners adhesively applied to said semi-cylindrical solid piece between said pair of middle slots; and a third strip of loop fasteners adhesively applied to said semi-cylindrical solid piece between said second end slot and said other end.

3. A baseball glove training device as claimed in claim 2, further comprising a pair of holes located a predetermined distance from said second end slot towards said other end of said semi-cylindrical solid piece.

* * * * *